US006195111B1

(12) United States Patent
Nelson et al.

(10) Patent No.: US 6,195,111 B1
(45) Date of Patent: Feb. 27, 2001

(54) CASSETTE CASING FOR THERMAL TRANSFER PRINTING DYE RIBBON

(75) Inventors: Anthony J Nelson, Woodbridge; Terence J Burch, Ipswich; Jeffrey B Orton, Colchester; Richard A Hann, Ipswich, all of (GB)

(73) Assignee: Imperial Chemical Industries PLC, London (GB)

( * ) Notice: Subject to any disclaimer, the term of this patent is extended or adjusted under 35 U.S.C. 154(b) by 0 days.

(21) Appl. No.: 09/230,827

(22) PCT Filed: Jul. 21, 1997

(86) PCT No.: PCT/GB97/01961

§ 371 Date: Jan. 29, 1999

§ 102(e) Date: Jan. 29, 1999

(87) PCT Pub. No.: WO98/04415

PCT Pub. Date: Feb. 5, 1998

(30) Foreign Application Priority Data

Jul. 31, 1996 (GB) ..... 9616032

(51) Int. Cl.[7] ..... B41J 32/00; B41J 35/36

(52) U.S. Cl. ..... 347/214; 400/207; 400/208; 400/208.1; 400/249

(58) Field of Search ..... 347/214; 400/208, 400/207, 208.1, 249

(56) References Cited

U.S. PATENT DOCUMENTS 4,970,531 * 11/1990 Shimizu et al. ..... 347/214
5,290,114 * 3/1994 Asami et al. ..... 400/208
5,352,049 * 10/1994 Shiraishi et al. ..... 400/208
5,385,416 * 1/1995 Maekawa et al. ..... 400/208

FOREIGN PATENT DOCUMENTS 40 35 598 5/1992 (DE) .
515 224 11/1992 (EP) .
546 944 6/1993 (EP) .
638 434 2/1995 (EP) .

OTHER PUBLICATIONS

Patent Abstracts of Japan, vol. 096, No. 007, Jul. 31, 1996 & JP 08 058201 A, Mar. 5, 1996.

* cited by examiner

*Primary Examiner*—Huan Tran
(74) *Attorney, Agent, or Firm*—Pillsbury Madison & Sutro LLP

(57) ABSTRACT

A dye ribbon cassette for thermal transfer printing comprising a casing containing bearing means having rotatably mounted thereon a cylindrical member having on its periphery a mark carrying information capable of being detected by a sensor on rotation of the member and means operatively engageable with a drive source which is disposed outside of the casing to cause rotation of the member. The cassette may include a pair of identical, spaced apart, shafts rigidly mounted at one end of the casing, one of the shafts forming the bearing means for the cylindrical member, the shafts forming respectively mounting points for a feed spool and a take up spool.

6 Claims, 2 Drawing Sheets

CASSETTE CASING FOR THERMAL TRANSFER PRINTING DYE RIBBON

This application is the national phase of international application PCT/GB97/01961 filed Jul. 21, 1997 which designated the U.S.

This invention relates to thermal transfer printing and more particularly to a cassette casing for holding the thermal ribbon during storage and when in use in a thermal printer.

Thermal transfer printing is a generic term for processes in which one or more thermally transferable dyes are caused to transfer from a dye sheet to a receiver sheet in response to thermal stimuli. Using a dye sheet comprising a thin substrate supporting a dye coat containing one or more such dyes uniformly spread over an entire printing area of the dye sheet, printing can be effected by heating selected discrete areas of the dye sheet whilst the dye coat is pressed against a receiver sheet. The shape of the pattern transferred is determined by the number and location of the discrete areas which are subject to heating. Complex images can be built up from large numbers of very small pixels placed close together, the resolution of the final image being determined by the number, size and spacing of such pixels. Full colour prints can be produced by printing with different coloured dye coats sequentially in like manner. Usually, the dye sheet is in the form of a ribbon with the different coloured dye coats being in the form of discrete stripes transverse to the axis of the ribbon in a repeated sequence along the ribbon, printing of the three colours being effected by moving the dye ribbon, in a printer, axially relative to the receiver sheet and whatever means are used to generate the thermal stimuli such as a print head consisting of a plurality of tiny heaters or a laser beam.

Conventionally, the ribbon is rolled up and stored in a cassette which consists essentially of a pair of spools and a moulded casing in which the spools are rotatably mounted in parallel and spaced apart positions. Each spool has end portions, by means of which the spool is mounted in the casing and a bobbin portion on which the ink ribbon is wound, one of the spools acting as a feed spool and the other acting as a take-up spool.

Cassette casings typically comprise two parallel, hemicylindrical spool housings having end portions interconnected by bridge members such that the housing and bridge members together define an open access port through which the ink ribbon is exposed to the thermal stimuli as it extends from one spool to the other.

Such a cassette has the drawback that no information is provided to the printer about the type and/or characteristics of the ink ribbon contained therein, for example whether the ribbon is mono or polychromatic or about the heat sensitivity of the specific dyes in the ribbon.

It is known to provide an information mark on the outside of the cassette which can be read by a sensor in the printer on insertion of the cassette. However, the amount of information that can be made available is limited in dependence on the amount of movement of the cassette past the sensor unless the sensor itself is capable of movement, which arrangement would unnecessarily complicate the printer.

U.S. Pat. No. 5,385,416 discloses a way of solving this problem by providing the information mark on the peripheral surface of the feed spool. On insertion of the cassette into the printer, the feed spool is rotated sot hat the information mark passes by a sensor. The amount of information that can be made available is thus independent of the way in which the cassette is inserted.

As pointed out in U.S. Pat. No. 5,290,114, this arrangement has the disadvantage that a portion of the ribbon is of necessity unwound during the information reading operation and either this portion is wasted or must be rewound before printing can start.

According to U.S. Pat. No. 5,290,114, this disadvantage may be overcome by providing the feed spool with a coaxial shaft portion and mounting a ring bearing the information mark on said shaft portion so that it can be rotated independently of the feed spool itself by drive means located in the printer.

The cassette body may be designed so that it can be reloaded with dye ribbon by the end-user, thus saving on the usage of raw materials and providing both cost and environmental benefits.

However, the arrangement of U.S. Pat. No. 5,290,114 results in a complex spool manufacturing process and, if the cassette is of the reloadable type, excessive wastage of raw materials required for a code wheel on each feed spool.

According to the present invention there is provided a dye ribbon cassette for thermal transfer printing comprising a casing containing bearing means having rotatably mounted thereon a cylindrical member having on tis periphery a mark carrying information capable of being detected by a sensor on rotation of the member and means operatively engageable with a drive source which is disposed outside of said casing to cause rotation of the member.

The arrangement according to the invention has several advantages over the arrangement of U.S. Pat. No. 5,290,114. In U.S. Pat. No. 5,290,114, each assembly of dye ribbon and feed and take-up spools requires its own cylindrical information carrying member whereas in the arrangement of the invention only one per casing is needed giving a reduction in materials usage and costs. There is also the risk of the information carrying member of U.S. Pat. No. 5,290,114 being damaged by clumsy handling during loading of a dye ribbon into the casing which risk is obviated in the arrangement of the invention. Also, in the arrangement of the invention, the assembly of the dye ribbon on to the feed and take-up spools is simplified and there is less chance of errors occurring.

Clearly, the positional relationship of the information carrying member to the drive means and the sensor, which are located in the printer, is critical for correct operation. In the invention, the information carrying member is fixed in position during manufacture of the casing whereas in U.S. Pat. No. 5,290,114 reliance is placed the feed spool being correctly positioned during reloading by the user. As a consequence, to reduce the possibility of incorrect positioning, the feed spool must be manufactured to exact dimensions whereas wider tolerances are possible with the arrangement of the invention.

The arrangement of the invention allows the feed and take-up spools to be identical which means that the spent feed spool can be used as a take-up spool. This is not possible with the arrangement of U.S. Pat. No. 5,385,414 and in the case of U.S. Pat. No. 5,290,114 either feed and take-up spools must be supplied or the additional step of removing the information carrying member from the spent feed spool is necessary making it difficult for the end user to reload the cassette body with fresh dyesheet.

The information carrying member may be mounted so as to be co-axial with the feed spool. Alternatively, it may be offset which has the advantage that different positioning of the sensor and the drive means can be accommodated.

According to a preferred aspect of the invention, a pair of identical, spaced apart shafts are rigidly mounted at one end of the casing the cylindrical member being mounted on one of said shafts so as to be rotatable thereon, the shaft protruding therethrough and forming a mounting point for a feed spool.

Each shaft preferably has an axial bore therein through which passes a rod, a spring being positioned between the rod and an endwall of the casing so that the rod is capable of axial movement against the tension of the spring.

According to a further aspect of the invention, there is provided a cassette for thermal transfer printing comprising a casing comprising two parallel, hemi-cylindrical spool housings having end portions interconnected by bridge members, the housings and bridge members together defining an open access port, a feed spool and a take-up spool located in said housings with a dye ribbon extending therebetween so as to extend across the port, a pair of identical shafts rigidly mounted on one of the bridge members so as to extend along the axes of the spool housings, each shaft having an axial bore therein through which passes a spring-loaded, axially movable rod, the end of which locates in and forms a mounting for a spool, a cylindrical member rotatably mounted on the shaft located in the feed spool and having on its peripheral surface a mark carrying information capable of being detected by a sensor on rotation of the member and means operatively engageable with a drive source which is disposed outside the casing to cause rotation of the member.

The invention will be more readily understood from the following description of an embodiment taken in conjunction with the accompanying drawing in which.

Figure 1:
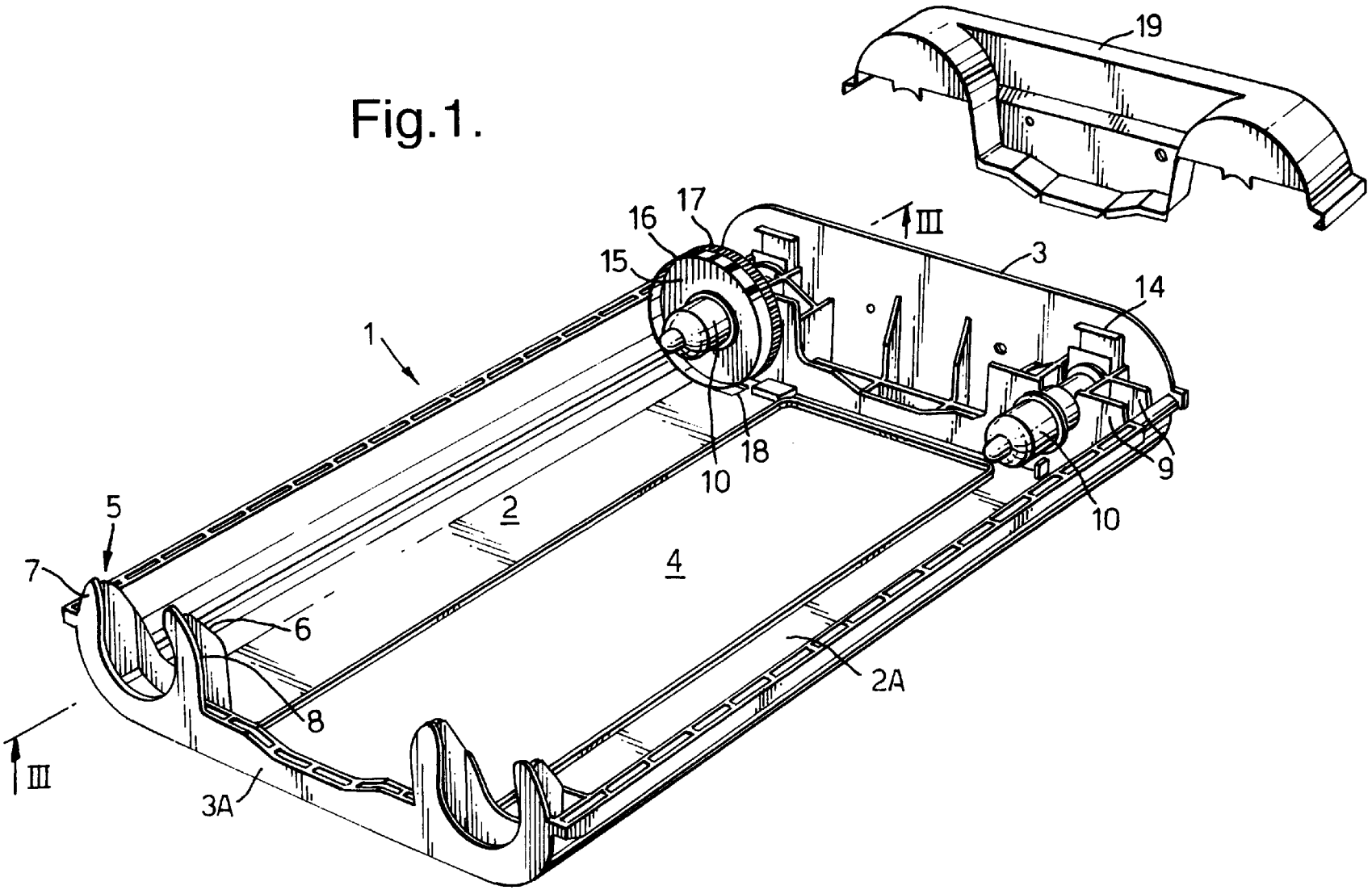
FIG. 1 shows an embodiment of a cassette casing.

Referring to FIG. 1, a casing 1, moulded from a suitable plastics material such as acrylonitrile/butadiene/styrene copolymer, which has the advantage of being re-cyclable, comprises two parallel, hemi-cylindrical spool housings 2, 2A having end portions interconnected by bridge members 3, 3A such that the housing and the bridge members together define an open access port 4. The bridge member 3A is formed so as to provide first spool locating means 5 consisting of a rib 6 and two arcuate upstands 7, 8 to form a major portion of an incomplete retaining ring. The bridge member 3 is provided with a pair of webs 9, each containing a U-shaped aperture in which a shaft 10 is rigidly mounted so as to be in line with the axis of the cylindrical portions and forming second spool locating means.

Figure 3:
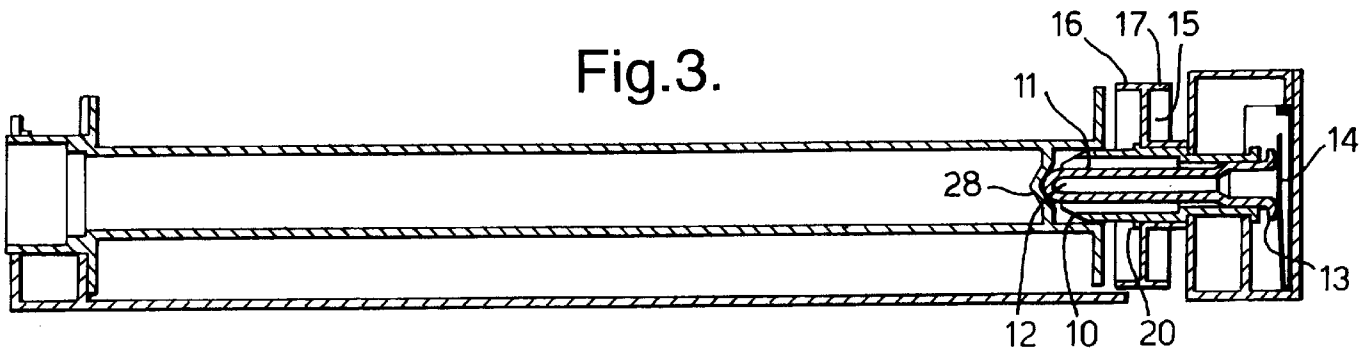
FIG. 3 is a cross-sectional view of a feed spool in the casing as indicated by lines III—III in FIGS. 1 and 2.

As shown in more detail in FIG. 3, each shaft 20 has an axial bore 11 therein through which passes a rod 12 having an enlarged head 13 and a leaf spring 14 is positioned between the head 13 and an endwall of the casing 1 so that the rod is capable of axial movement against the tension of the spring 14.

The shaft mounted in the hemi-cylindrical portion 2 of the casing has a cylindrical member 15 rotatably mounted thereon, the peripheral surface of the cylindrical member carrying an information mark 16, e.g. a bar code, and a gear ring 17. As can be seen from FIG. 1, the shaft 10 is sufficiently long so as to protrude past the end face of the cylindrical member. An aperture 18 in the casing allows engagement of the gear ring 17 by suitable drive means in the printer, for example drive means as described in U.S. Pat. No. 5,385,416. The ends of the shafts and the leaf springs are enclosed and retained in the webs by a cover 19. As shown in FIG. 3, axial movement of the cylindrical member on the shaft is prevented by the cylindrical member being located between an annular protrusion 20 on the shaft and the cover.

Figure 2:
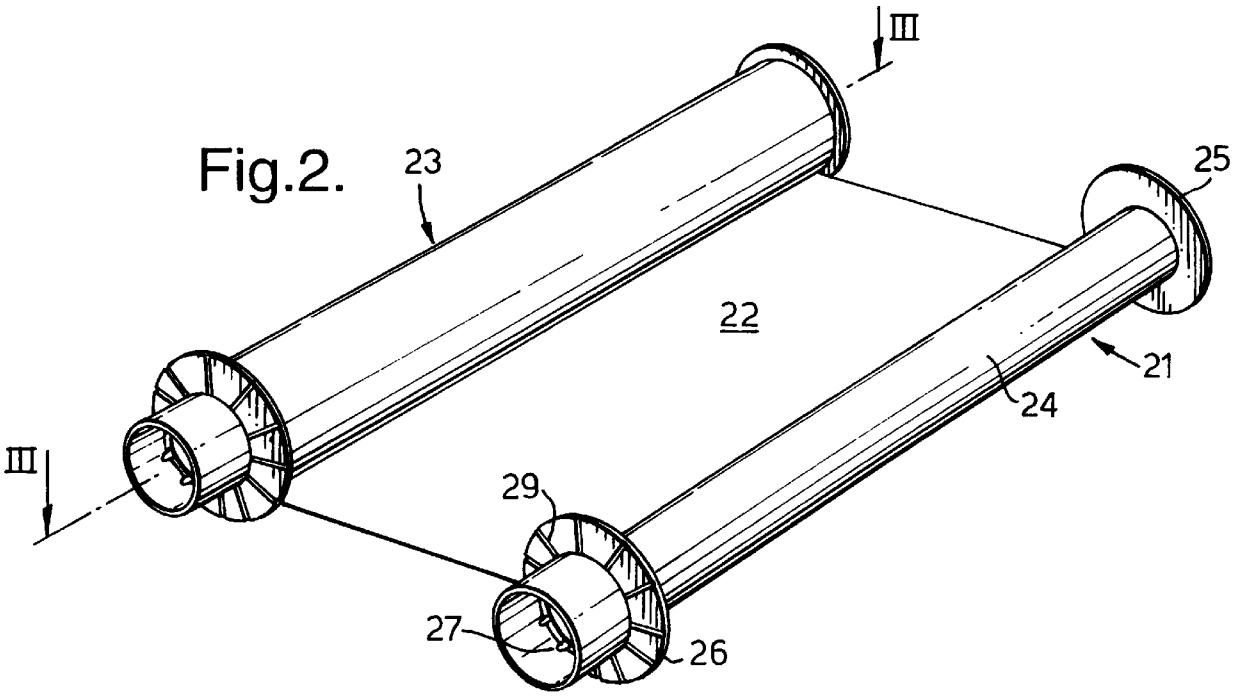
FIG. 2 shows a dye ribbon feed unit for use in the casing of FIG. 1.

Referring now to FIG. 2, a dye ribbon unit for insertion into the casing, consists of a take-up spool 21 to which the end of a dye ribbon 22 is attached and a feed spool 23 on which the dye ribbon is wound. The spools are identical and each consists of a cylindrical, bobbin portion 24 carrying a first flange 25 at one end and a second flange 26 spaced from the first flange by a distance slightly greater than the width of the dye ribbon. The end of the cylindrical portion beyond the flange 26 is hollow and has a printer drive receiving cavity with internal gear teeth 27 for engagement with suitable drive means in the printer. As shown in FIG. 3, at the end of the spool carrying the flange 25, an internal recessed web 28 is provided at an appropriate position such that the rod 12 and the recess 28 form a bearing when the spool is positioned in the casing. Such an arrangement has an advantage over the arrangement shown in U.S. Pat. No. 5,290,114 in which a pip or nipple, which could be broken if the spool is badly handled, for example during transit, protrudes from the end of the spool.

Further details of the construction of the casing and the dye ribbon unit will become apparent from the following description of the operation of placing the dye ribbon unit into the cassette.

The spools are held at a slight inclination to the plane of the cassette and the flanges 25 are slid over the shafts until the rods are received into the recesses provided inside the spools. Axial pressure is then applied to move the rods against the resistance of the springs until the other ends of the spools overlie the arcuate upstands 7, 8 which are sufficiently resilient to allow the ends of the spools to pass therebetween upon downward pressure being applied. The flanges 26 are provided with recesses or protuberances 29 which locate with corresponding recesses or protuberances (not shown) in the rib 6 to retain the spools during transit of the cassette. On insertion of the cassette into the printer, the gear teeth 27 engage with the printer drive means and cause axial movement of the spools against the springs 14 until the protuberances are clear of the recesses so as to allow rotation of the spools.

The information mark may be similar to that disclosed in U.S. Pat. No. 5,209,114, i.e. it may consist of two separate bar codes each covering half the circumference of the cylindrical member, although other configurations are of course possible. On energisation of the printer, the gear ring 17 is engaged by a drive source in the printer and caused to rotate relative to the feed spool so that at least one of the bar codes is read by a conventional reflection type sensor installed at an appropriate position in the printer.

What is claimed is:

1. A dye ribbon cassette for thermal transfer printing, the cassette being adapted to receive a dye ribbon feed unit having a feed spool (23), a take-up spool (21) and a dye ribbon (22) extending between the feed spool (23) and the take-up spool (21), the cassette including a casing (1) having on one side thereof locating means (5) for locating ends of the feed spool (23) and the take-up spool (21) on one side of the dye ribbon feed unit at which rotational drive is applied to the dye ribbon feed unit for the purpose of transporting the dye ribbon (22) from the feed spool (23) to the take-up spool (21) and the casing (21) having on the other side thereof bearing means (10) for supporting ends of the feed spool (23) and the take-up spool (24) on the other side of the dye ribbon feed unit, characterised in that on the other side of the casing (21) a cylindrical member (15) is rotatably mounted on the bearing means (10), the cylindrical member (15) having on its periphery a mark (16) carrying information capable of being detected by a sensor on rotation of the cylindrical member (15) and drive means (17) operatively engageable with a drive source which is disposed outside said casing to cause rotation of the cylindrical member (15), and characterised in that the cylindrical member (15) and the drive means (17) thereon occupy their operative positions in the casing (21) irrespective of the presence in the casing (21) of the dye ribbon feed unit.

2. A cassette according to claim 1, characterised in that a pair of identical, spaced apart, shafts (10) are rigidly mounted at said one side (21) of the casing, one of said shafts forming said bearing means for the cylindrical member (15), the shafts (10) forming respectively mounting points for the feed spool (23) and the take-up spool (21).

3. A cassette according to claim 2, characterised in that each shaft (10) has an axial bore therein through which passes a rod (12), a spring (14) being positioned between the rod (12) and an endwall of the casing (21) so that the rod (12) is capable of axial movement against the influence of the spring.

4. A cassette according to any of the preceding claims, characterised in that the drive means comprise a gear ring (17) formed on the outer periphery of the cylindrical member (15).

5. A cassette according to claim 1, 2 or 3, characterised in that the mark (16) comprises bar codes.

6. A cassette according to claim 1, 2, or 3, characterised in that the cassette is in combination with the dye ribbon feed unit, the take-up spool (21) having on said one side of the feed unit gear teeth (27) for engagement with drive means in a printer.

* * * * *